United States Patent [19]

Johnson

[11] Patent Number: 4,876,809

[45] Date of Patent: Oct. 31, 1989

[54] METHOD OF IDENTIFICATION OF ROLLED-UP SHEETS OF MATERIAL

[76] Inventor: Frank M. Johnson, 530 S. Seventh, Ann Arbor, Mich. 48103

[21] Appl. No.: 134,505

[22] Filed: Dec. 16, 1987

[51] Int. Cl.[4] ..... G09F 3/00

[52] U.S. Cl. ..... 40/309

[58] Field of Search ..... 40/309, 316, 306, 299, 40/660, 665; 206/407, 409, 389, 417, 487, 390; 24/7, 17 B

[56] References Cited

U.S. PATENT DOCUMENTS

| | | | |
|---|---|---|---|
| 1,693,363 | 11/1928 | Bennett | 40/309 |
| 3,491,472 | 1/1970 | Walldorf | 40/316 |
| 3,650,059 | 3/1972 | Johnson | 40/316 |
| 3,718,999 | 3/1973 | Voyce | 40/309 |
| 3,896,524 | 7/1975 | Parker | 24/17 B |
| 3,962,807 | 6/1978 | Pantone | 40/359 |
| 4,235,335 | 11/1980 | Cosintine | 206/389 |
| 4,339,885 | 7/1982 | Brown | 40/309 |
| 4,361,230 | 11/1982 | Downing et al. | 206/390 |
| 4,363,401 | 12/1982 | Savagian | 206/390 |
| 4,425,390 | 1/1984 | Changani et al. | 40/316 |
| 4,471,547 | 1/1984 | Koslow | 40/309 |

FOREIGN PATENT DOCUMENTS

| | | | |
|---|---|---|---|
| 1391913 | 2/1965 | France | 40/316 |
| 1039122 | 8/1966 | United Kingdom | 40/316 |

*Primary Examiner*—Robert Peshock
*Assistant Examiner*—Cary E. Stone
*Attorney, Agent, or Firm*—Irving M. Weiner; Joseph P. Carrier; Robert M. Petrik

[57] ABSTRACT

A device for identifying and storing rolled-up sheets of material such as blueprints, drawings, etc. The device includes a combination retainer/identifier which in a cylindrical sleeve configuration thereof may be slid onto the rolled-up sheet to retain same at a fixed diameter, while serving the dual purpose of displaying indicia for identifying the sheet. A plurality of retainer/identifiers are provided in a collapsed-tube rolled form and positioned within a dispenser for individual dispensing thereof by tearing along perforations.

5 Claims, 1 Drawing Sheet

METHOD OF IDENTIFICATION OF ROLLED-UP SHEETS OF MATERIAL

BACKGROUND OF THE INVENTION

1. Field of the Invention

The present invention relates generally to an identification and storage device for rolled-up sheets of material, such as large sheets of paper containing blueprints, engineering drawings, architectural drawings, etc. More particularly, the invention relates to a device serving the dual purpose of retaining the rolled-up material in rolls of uniform diameter, and displaying identifying indicia for storing the rolls according to predetermined types or categories.

The terminology "rolled-up sheets of material" as employed herein is intended to connote any type of sheet material which is rolled into tubular form for storage. As such, such terminology embraces not only documents such as blueprints, engineering drawings, architectural drawings, etc., but also other types of rolled material such as wall paper, for example.

2. Description of Relevant Art

The storage of large sheets of paper, such as blueprints, engineering drawings, architectural drawings, etc., is commonly effected by rolling the sheets thereof into tubular form, thus avoiding undesirable fold lines. In order to retain the drawing sheets in such rolled-up form, some type of retaining means, such as rubber bands secured around circumferential portions of the rolled-up sheets, are often employed. Inherent in the use of such retaining means for storing a number of rolls of sheets, however, is an undesirable non-uniformity in the diameters of the rolls. Neat and orderly stacking of the rolls is thus substantially impaired by the inconsistency in diameters.

Another problem arising with respect to storing sheets of the aforesaid type in rolled-up form is the difficulty in identifying a particular rolled sheet(s) for selection from a stack of other rolled sheets.

A number of known devices have been provided for identifying rolled sheets, and for maintaining materials in rolled-up form. Illustrative ones of such devices are disclosed in the following United States patents.

The "IDENTIFICATION DEVICES" disclosed in U.S. Pat. No. 3,718,999 issued in 1973 to Voyce comprise circular tab means adapted to be retained at the ends of rolled-up sheets of material by a U-shaped attaching means inserted through slots in the tab. A pair of displaced legs of the attaching means frictionally engage opposed inner surfaces of the roll to retain the tab in position at the end of the roll, and the tab may be marked with identifying indicia. The attaching means may alternatively comprise an elastic band extending along outer portions of the roll, and engaging with recesses in the tab.

The "RIBBON PACKAGE" disclosed in U.S. Pat. No. 4,235,335 issued in 1980 comprises dispensing package for rolls of non-adhesive ribbon material. The package includes a flat sheet of paperboard provided with an adhesive surface for adhering to edges of the rolled ribbon which define a flat surface. Alternatively, two such sheets may be employed, engaging opposite respective flat surfaces of the ribbon roll.

The "IDENTIFICATION MEANS FOR ROLLED-UP ARTICLES, SUCH AS DRAWINGS AND THE LIKE" disclosed in U.S. Pat. No. 4,339,885 issued in 1982 to Brown comprises a tubular member for receiving the end of a rolled-up sheet therein. The tubular member includes an identification cap portion at one end thereof, provided with a label for identifying indicia. A first body of the tubular member is adapted to receive the end of the roll, and a second body disposed between the cap and the first body includes gripping means for frictionally engaging the roll to facilitate removal thereof from a stack.

The "IDENTIFICATION INSERT FOR LABELING DRAWINGS OR THE LIKE AND METHOD THEREFOR" disclosed in U.S. Pat. No. 4,471,547 issued in 1984 to Koslow comprises a tubular member having a collar tab flanged outwardly at an end thereof, the tab having a label for identifying indicia provided thereon. The tubular member is adapted to be inserted into the end of a roll of paper such that the collar tab is disposed at the end of the tube. A mandrel is used for pre-rolling the paper sheet, is then removed from the roll, and rubber bands are secured around the roll prior to insertion of the tubular member.

The present invention overcomes various shortcomings of the above-described known devices by providing a device including a combination retainer and identification means for retaining sheets of paper or other material in rolls of uniform diameter for neat and orderly storage. The retaining means serves the dual purpose of also functioning as a means for displaying identifying indicia to permit easy and convenient identification of a rolled-up sheet for selection from a stack of such rolled sheets.

SUMMARY OF THE INVENTION

The present invention provides an identification and storage device for rolled-up sheets of material to be stored, which comprises a plurality of retainer means for retaining sheets of material in respective rolls having substantially equal diameters. Each of the retainer means is fabricated of a flexible sheet material so as to be deformable from a substantially flat configuration to a substantially cylindrical configuration for receiving a rolled-up sheet of material to be stored therein. Identification means is provided on an outer surface portion of each of the retainer means.

In a preferred embodiment, the plurality of retainer means comprise an elongated tube of flexible material (e.g., plastic) having transverse perforations provided at regular spaced intervals to permit removal of individual ones of the retainer means from the elongated tube. The elongated tube is adapted to be collapsed into the flat configuration and rolled-up for storage and dispensing of individual ones of the retainer means. Preferably, a dispenser is provided for storing the rolled-up flattened elongated tube, the dispenser being formed with a slot adapted to permit an outer end of the flattened tube roll to extend therethrough to permit removal of individual retainer means.

The identification means comprises a plurality of pre-printed labels, each being integrally affixed to one of the retainer means. Preferably, the labels are color-coded to identify respective types or categories of the rolled-up sheets of material to be stored.

The present invention also provides a method for identifying and storing rolled-up sheets of material, comprising the steps of: rolling the material to be stored to a first predetermined diameter; deforming a combination retainer and identification means from a collapsed-tube configuration thereof to a substantially cylindrical configuration thereof having a second predetermined diameter greater than the first predetermined diameter; and applying the combination means to the rolled material to retain it in rolled condition at the second predetermined diameter, by sliding the combination means over one end of the rolled material to a position surrounding a substantially central portion of the rolled material.

It is an object of the present invention to provide a device which provides retaining means for storing rolls in uniform diameters, and wherein the retaining means itself incorporates identification means which permits storage of the rolls in an ordered system according to types or categories.

A further object of the invention is to provide a combination retainer and identification means which is of simplified construction, is inexpensive to manufacture, and which greatly facilitates storage and identification of rolled-up material relative to other known arrangements.

The above and further objects, details and advantages of the present invention will become apparent from the following detailed description, when read in conjunction with the accompanying drawings.

DETAILED DESCRIPTION OF PREFERRED EMBODIMENTS

Figures 1, 2, 3:
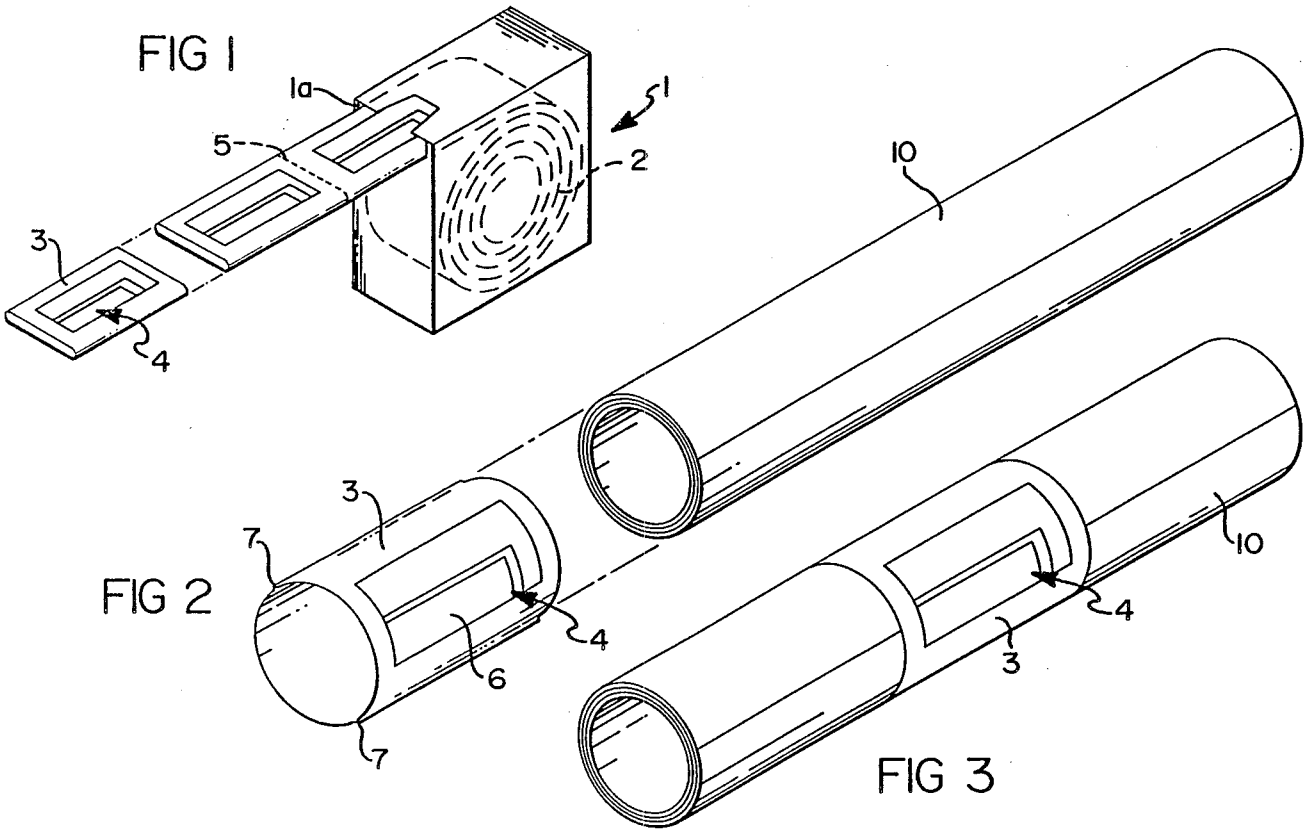
FIG. 1 is a perspective view of a plurality of the combination retainer and identification devices according to the invention, as provided in a collapsed tube configuration and rolled for storage in a dispenser which permits dispensing of individual ones of the devices.
FIG. 2 is a perspective view showing one of the combination retainer and identification devices deformed from its collapsed state to a substantially cylindrical shape for sliding over the end of a roll of material to be stored.
FIG. 3 is a perspective view showing the combination retainer and identification device in its operable position on a roll of material to be stored.

With reference to FIG. 1, there is shown a dispenser 1 containing a roll 2 which includes a plurality of the combination retainer and identification devices 3 (hereinafter referred to as "retainers 3") according to the invention. The dispenser 1 is generally box-shaped with a substantially hollow interior for housing the roll 2, and is provided with a dispensing opening or slot 1*a* through which the free end of the roll 2 may protrude to permit individual dispensing of the retainers 3 as described hereinbelow. Preferably, dispenser 1 is fabricated of a sturdy material such as heavy weight paper, cardboard or plastic, so that it may be re-filled for extended use.

The roll 2 of the retainers 3 is formed as follows. An elongated strip of flexible sheet material such as plastic, vinyl or plastic-coated paper is formed into a tube by overlapping the side edges thereof and forming a longitudinal seam along said overlapped edges by any suitable means (heat seal, adhesive, etc.). It will be understood, however, that the elongated tube of stock material may be formed in accordance with any other desired method, provided that an integral elongated tubular shape is attained. Preferably the material used for forming the tube may be of decorative colors or of a reflective type for aesthetic purposes and high visibility.

The diameter of the thus-formed tubular stock is selected in accordance with the desired final diameter of the rolls of drawings, etc. to be stored. In this respect, it is contemplated that various diameters (ranging from less than one inch and up to several inches, for example) of tubular stock may be formed so as to produce sets of retainers 3 having diameters which vary from set to set. The provision of sets of retainers 3 in varying diameters permits the user to select a suitable size retainer 3 for accommodating rolls formed by rolling-up various sizes of documents, drawings, blueprints, plans, etc. To this end, the size of dispenser 1 can be adapted to accommodate rolls 2 of varying size, and it is further contemplated that an enlarged dispenser 1 can be provided which permits storage and dispensing of a plurality of rolls 2 of varying size.

A series of pre-printed labels 4 is integrally affixed to the tubular stock at regular spaced-apart intervals in the longitudinal direction on one outer side surface. The labels 4 may be pre-printed on the flexible material stock prior to formation into the tubular configuration, or alternatively the labels 4 may be separately applied after formation into the tubular configuration.

The labels 4 preferably each include a blank marking area 6 (FIG. 2) which permits the user to mark any desired identifying indicia thereon, and to this end such portion 6 of label 4 (or label 4 in its entirety) can be fabricated of a material such as paper or the like which permits marking thereon with a conventional writing implement. The labels 4 may also desirably be custom printed with a company name and/or logo (e.g., "XYZ Company" as shown in the FIGURE), which may include address and/or telephone information for the company. It is further contemplated, in accordance with a preferred embodiment of the invention, that the labels 4 be color-coded by being marked with varying colors, and/or be marked with varying sets of graphics for coding purposes. By providing sets of labels 4 of varying colors and/or graphics, the user can rely on such varying colors and/or graphics to systematically store rolls of documents or drawings according to various types or categories (e.g., by dates, draftsman or author, customer, project, etc.).

To permit convenient storage and dispensing of the retainers 3, the tubular stock formed as described hereinabove is collapsed into a substantially flat configuration, with longitudinal crease lines 7 being formed along each side thereof, for example. The longitudinal seam of the tube may extend along one of such crease lines, or alternatively may be arranged on the surface of the tube opposite label 4.

Transverse perforations 5 as shown in FIG. 1 are provided at regular spaced intervals along the longitudinal extent of the tubular stock, the perforations defining therebetween individual retainers 3 with associated labels 4. The distance between perforations 5 will of course define the length of the individual retainers 3, and it will be understood that such lengths may be selected as desired. Typically, however, such length should be greater than the diameter of the tubular stock, and may preferably be chosen to be proportionately greater for retainers 3 of larger diameter.

When the collapsed tube is thereafter wound into the roll 2 as shown in FIG. 1, it can be disposed in dispenser 1 for convenient individual dispensing of retainers 3. As shown in FIG. 1, the outermost retainer 3 has been separated from the roll 2 merely by tearing along the outermost perforation 5.

Although it is also contemplated that retainers 3 may be provided as separate individual units in stacked arrays, for example, the above-described roll dispensing configuration is preferred due to the storage and dispensing convenience which it affords.

To employ the retainers 3 for use in systematically identifying and storing rolled-up sheets of material, a retainer 3 of a desired size, and color or graphics code, is selected and removed from its associated roll 2 in dispenser 1, as shown in FIG. 1. The blank writing area on label 4 may then be marked with desired identifying indicia (e.g., project or customer, date, etc.). The retainer 3 is then applied to the rolled-up sheet(s) to be stored as follows.

The sheet(s) 10 to be stored is rolled to a first predetermined diameter which is slightly less than the diameter of the selected retainer 3. The retainer 3 in its collapsed or flat state is then deformed into the substantially cylindrical sleeve configuration shown in FIG. 2. In this respect it will be understood that the material of which retainers 3 are formed is sufficiently flexible to permit ready deformation (i.e., expansion) into such cylindrical sleeve configuration. Such deformation step may be facilitated by any one or more of the following procedures: insertion of the user's finger into one end of the collapsed retainer 3; sliding the opposite surfaces of collapsed retainer 3 relative to each other to deform the open ends of retainer 3; and/or applying pressure at the opposing side crease lines of collapsed retainer 3.

With retainer 3 deformed or expanded to the aforesaid substantially cylindrical sleeve configuration, the roll of paper 10 to be stored is inserted into one end of retainer 3 as shown in FIG. 2. The retainer 3 is then slid along the outer peripheral surface of the roll 10 to a substantially central position in the longitudinal direction of roll 10, as shown in FIG. 3. With retainer 3 thus positioned, the diameter of the paper roll 10 will expand slightly to the diameter of retainer 3 thereon, and thus will remain snugly fit within retainer 3.

The retainer 3 as thus positioned on roll 10 will retain roll 10 in its rolled condition at a diameter corresponding to the diameter of the selected retainer 3. A number of the retainers 3 can thus function to maintain a plurality of respective rolls 10 at a uniform diameter, thus permitting neat and orderly storage of rolls 10. The label 4 provided on retainer 3 is highly visible (as is retainer 3 itself) to permit ready identification of a particular roll 10 to be selected from a stack of such rolls (via pre-printed colors and/or graphics, as well as manually marked indicia), without requiring unrolling of the document or drawing.

From the foregoing it will be understood that each retainer 3 serves the dual function of retaining the roll 10 in its rolled state at a predetermined diameter, and providing convenient identification of the document or drawing via the indicia marked on label 4 of retainer 3. When it is desired to unroll the roll 10 to view the document or drawing, the user has merely to slide retainer 3 off one end of the roll 10. Thereafter, the retainer 3 may be reused merely by repeating the above-described steps of rolling the paper to define roll 10 and sliding retainer 3 over one end and into a central position on roll 10.

Although there have been described what are at present believed to be the preferred embodiments of the invention, it will be understood that the foregoing description is to be considered as illustrative, and not restrictive. Various modifications may be made therein without departing from the spirit of the invention. The scope of the invention is indicated by the following c aims.

I claim:

1. A method for identifying and storing rolled-up sheets of material, comprising the steps of:

rolling said material to a first predetermined diameter;

deforming a combination retainer and identification means from a collapsed-tube configuration thereof to a substantially cylindrical configuration thereof having a second predetermined diameter which is greater than said first predetermined diameter; and applying said combination retainer and identification means to said rolled material to retain it in rolled condition at said second predetermined diameter, by sliding said combination retainer and identification means over one end of said rolled material to a position surrounding a substantially central portion of said rolled material.

2. A method according to claim 1, wherein:

prior to said deforming step, said combination retainer and identification means is marked with identifying indicia.

3. A method according to claim 2, wherein:

prior to said deforming step, said combination retainer and identification means is removed from a perforated roll containing a plurality of said combination retainer and identification means.

4. A method according to claim 2, wherein:

said combination retainer and identification means comprises a pre-printed label including a marking surface for marking said identifying indicia thereon.

5. A method according to claim 1, wherein:

said pre-printed label is color-coded to identify a respective type or category of said rolled material; and said method further comprises the step of storing a plurality of rolls of said rolled material in an ordered system according to said type or category.

* * * * *

UNITED STATES PATENT AND TRADEMARK OFFICE

CERTIFICATE OF CORRECTION

PATENT NO. : 4,876,809

DATED : Oct. 31, 1989

INVENTOR(S) : Frank M. JOHNSON

It is certified that error appears in the above-identified patent and that said Letters Patent is hereby corrected as shown below:

Column 1, line 58, after "comprises" insert --a--.

Column 4, line 32, delete "as shown in the FIGURE".

Column 6, line 15, delete "c";
line 16, change "aims" to --claims--;
line 48 (claim 5, line 1), after "claim" change "1" to --4--.

Signed and Sealed this

Twenty-first Day of May, 1991

*Attest:*

HARRY F. MANBECK, JR.

*Attesting Officer*

*Commissioner of Patents and Trademarks*